US009091101B2

(12) United States Patent
Paskonis

(10) Patent No.: US 9,091,101 B2
(45) Date of Patent: Jul. 28, 2015

(54) VEHICLE LIFTGATE STRIKER AND LATCH CONSTRUCTION

(75) Inventor: Almantas K. Paskonis, Concord Township, OH (US)

(73) Assignee: MSD Stamping LLC, Livonia, MI (US)

( * ) Notice: Subject to any disclaimer, the term of this patent is extended or adjusted under 35 U.S.C. 154(b) by 121 days.

(21) Appl. No.: 13/702,772

(22) PCT Filed: Jun. 7, 2011

(86) PCT No.: PCT/US2011/039455

§ 371 (c)(1),
(2), (4) Date: Jun. 6, 2013

(87) PCT Pub. No.: WO2011/156382

PCT Pub. Date: Dec. 15, 2011

(65) Prior Publication Data

US 2013/0249220 A1 Sep. 26, 2013

Related U.S. Application Data

(60) Provisional application No. 61/397,111, filed on Jun. 7, 2010.

(51) Int. Cl.

| | |
|---|---|
| ***E05C 19/10*** | (2006.01) |
| ***E05B 83/16*** | (2014.01) |
| ***E05B 17/00*** | (2006.01) |
| ***E05B 85/04*** | (2014.01) |
| ***E05B 77/38*** | (2014.01) |

(52) U.S. Cl.

CPC ..... *E05B 83/16* (2013.01); *E05B 17/0033* (2013.01); *E05B 77/38* (2013.01); *E05B 85/045* (2013.01)

(58) Field of Classification Search

USPC ..... 292/95, 340, 341.12, 341.13, 346, 337

See application file for complete search history.

(56) References Cited

U.S. PATENT DOCUMENTS

| | | | | |
|---|---|---|---|---|
| 6,042,160 | A | 3/2000 | Hamada et al. | |
| 7,144,065 | B2 | 12/2006 | McClure et al. | |
| 2002/0000727 | A1* | 1/2002 | Rass et al. | 292/216 |
| 2007/0114802 | A1 | 5/2007 | Johnson et al. | |
| 2007/0241570 | A1 | 10/2007 | Paskonis | |

OTHER PUBLICATIONS

International Search Report re PCT/US2011/039455, dated Oct. 7, 2011, 2 pgs.

International Preliminary Report on Patentability re PCT/US2011/039455, dated Dec. 10, 2012, 1 pg.

Written Opinion re PCT/US2011/039455, dated Sep. 28, 2011, 4 pgs.

* cited by examiner

*Primary Examiner* — Mark Williams

(74) *Attorney, Agent, or Firm* — McDonald Hopkins LLC

(57) ABSTRACT

Several vehicle liftgate striker and latch constructions are disclosed. The striker includes a striker base from which at least one striker pin extends. A latch, having a latch cover, Is configured to be mounted on a vehicle liftgate, for juxtaposition to the striker base when the liftgate is closed and the latch engages the at least one striker pin. The striker includes a reactor structure for making contact with the latch cover, when the liftgate is closed, for controlling lateral movement of the latch relative to the striker base. The reactor structure preferably Includes at least one roller mounted on a roller support, The latch cover has at least one side which Is angled, so as to exert force, having a lateral component, on the reactor structure. The at least one angled side of the latch cover may Include a detent, for providing additional restraining force, when the liftgate is In the closed position.

16 Claims, 21 Drawing Sheets

VEHICLE LIFTGATE STRIKER AND LATCH CONSTRUCTION

FIELD OF THE INVENTION

The invention relates to locking mechanisms, particularly for vehicle liftgates, and further in particular to striker and latch structures, as opposed to actual lock mechanisms.

SUMMARY OF THE INVENTION

The present invention is directed to vehicle liftgate striker and latch constructions, used to hold a vehicle liftgate in, and release it from, a closed and locked position.

In particular, the present invention is directed to a vehicle liftgate striker and latch construction which is configured to control lateral movement of the liftgate, relative to the striker, and to provide assistance in pushing the liftgate away from the striker, when the latch is unlocked, by advantageously configuring the latch cover with a tapered profile, in combination with resilient latch reaction assemblies associated with the striker assembly.

BRIEF DESCRIPTION OF THE DRAWINGS

Any indicia shown herein are for illustrative purposes only, and the scope of the invention is not to be construed to be limited thereto. Any numerical values appearing herein are provided solely as examples of an embodiment or embodiments of the invention, and the scope of the invention is not limited by them.

DETAILED DISCLOSURE OF THE INVENTION

Figure 1:
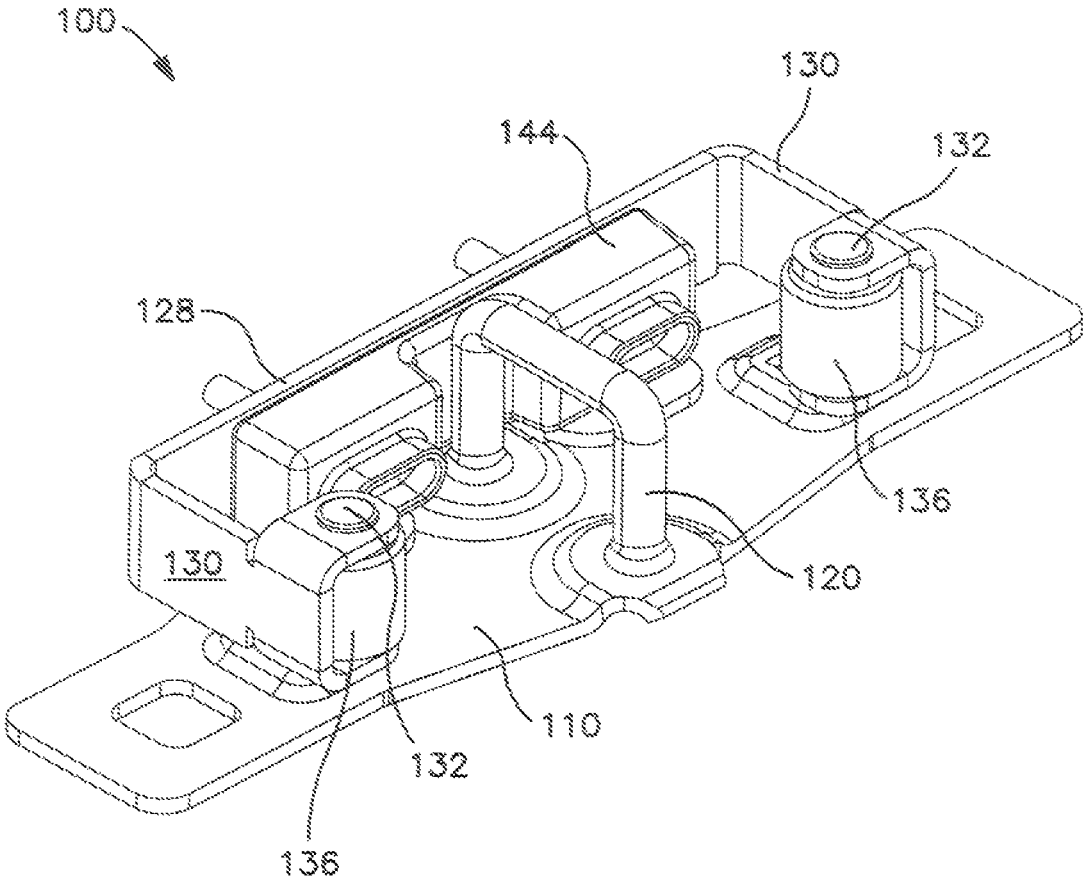
FIG. 1 is a perspective view of the striker assembly according to an embodiment of the invention.
Figure 2:
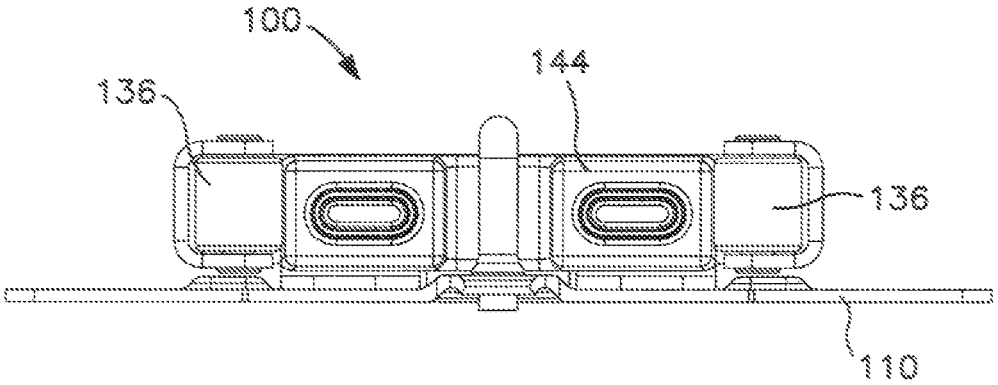
FIG. 2 is a front view of the striker assembly of FIG. 1.
Figure 3:
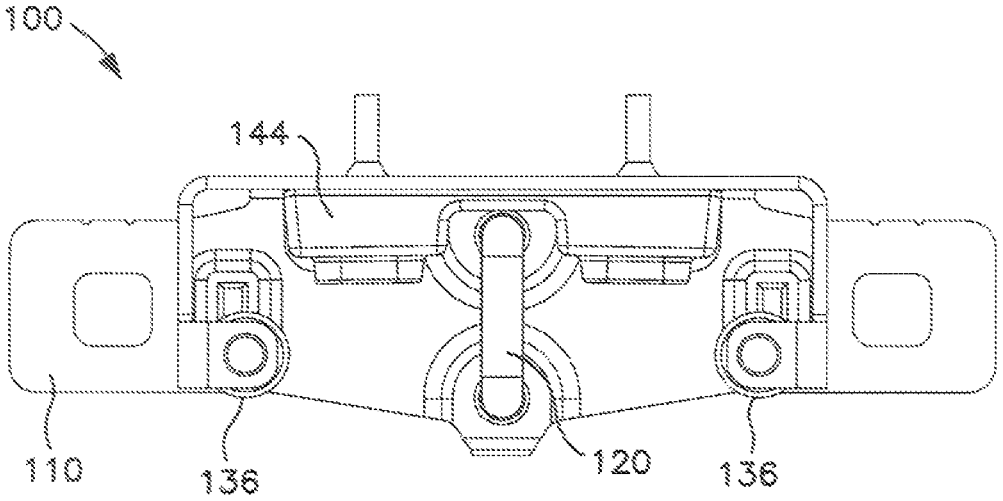
FIG. 3 is a top view of the striker assembly of FIG. 1.
Figure 4:
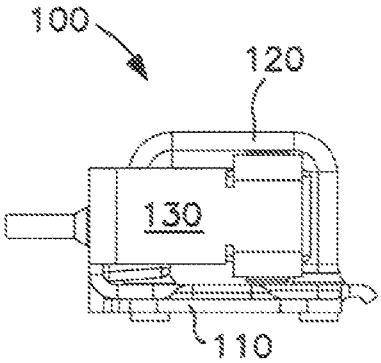
FIG. 4 is an end view of the striker assembly of FIG. 1.
Figure 5:
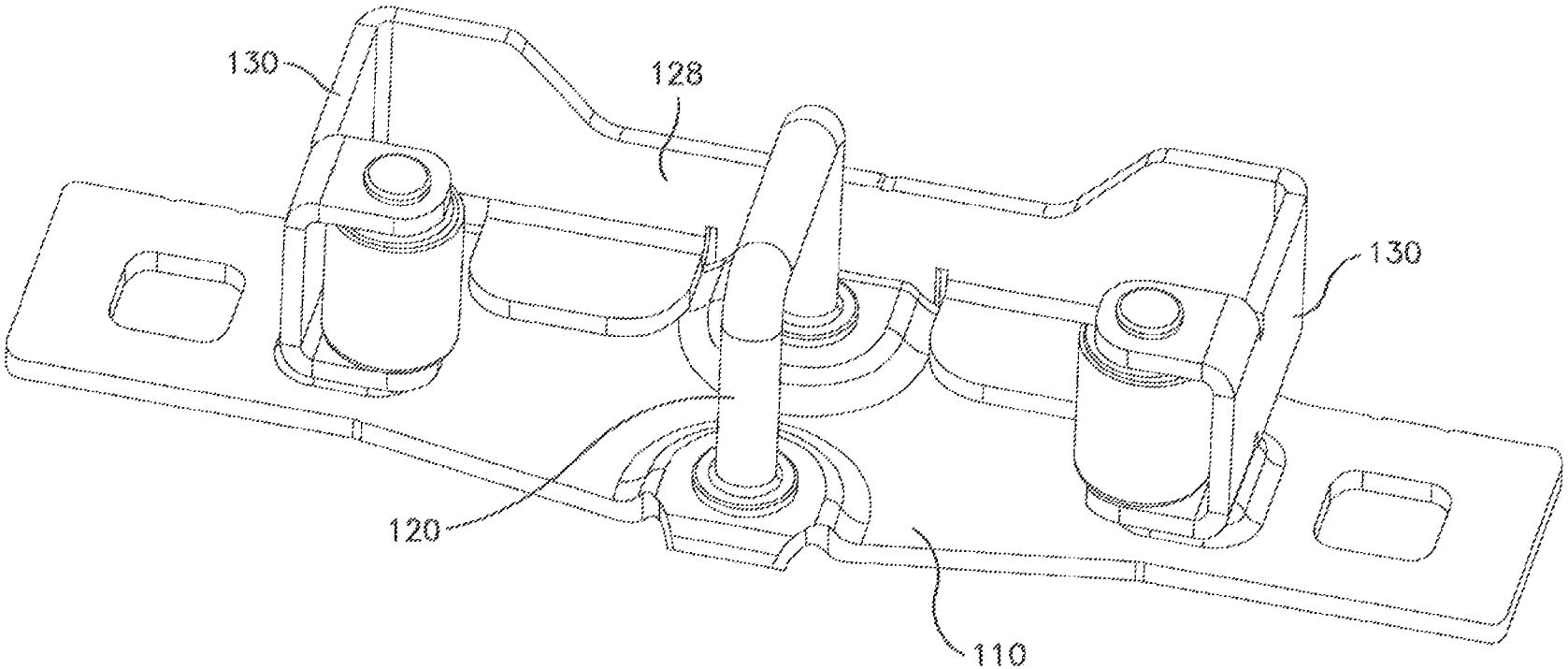
FIG. 5 is a perspective view of the striker assembly of FIG. 1, with the overtravel bumper omitted.
Figure 6:
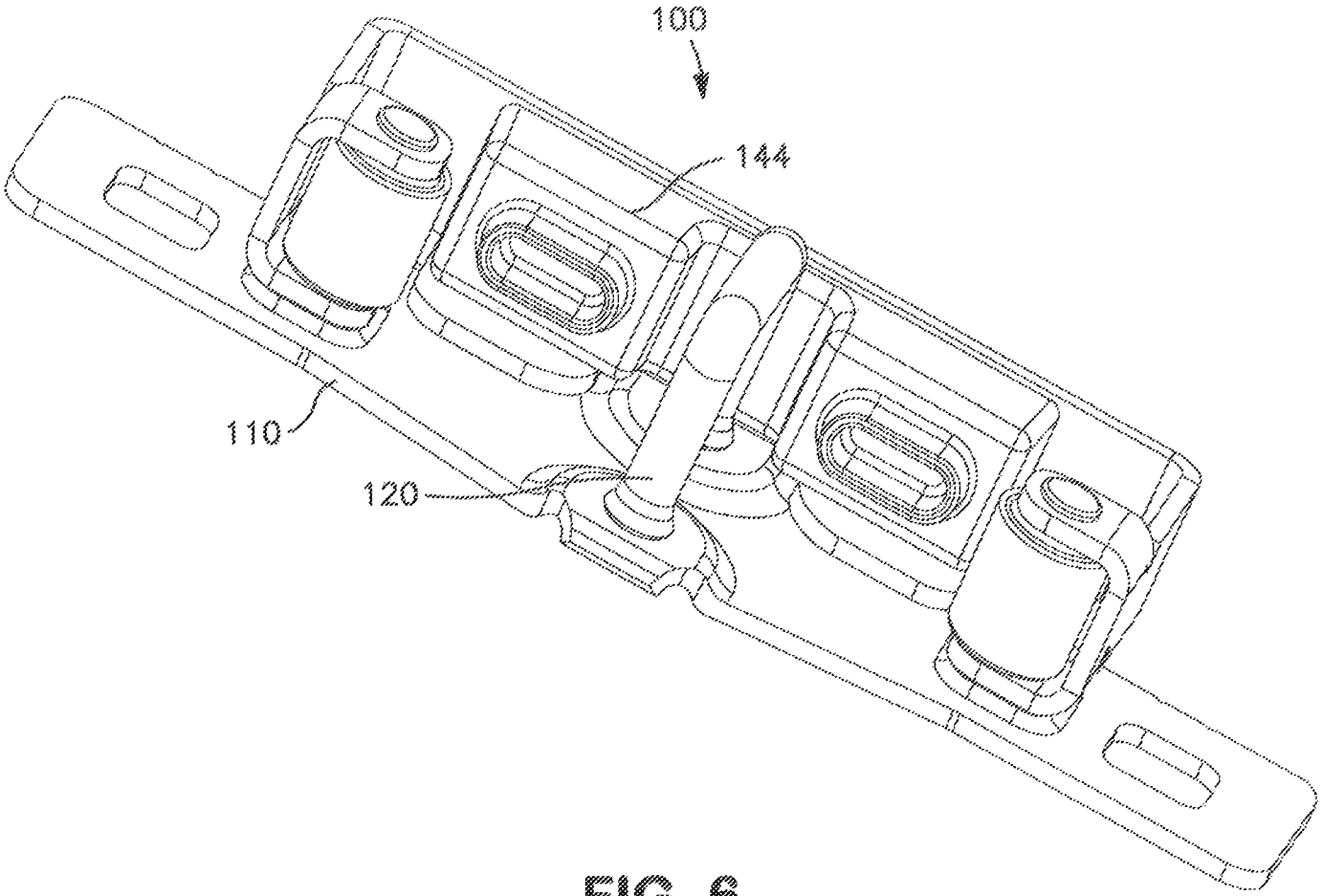
FIG. 6 is a another perspective view of the striker assembly of FIG. 1.
Figure 7:
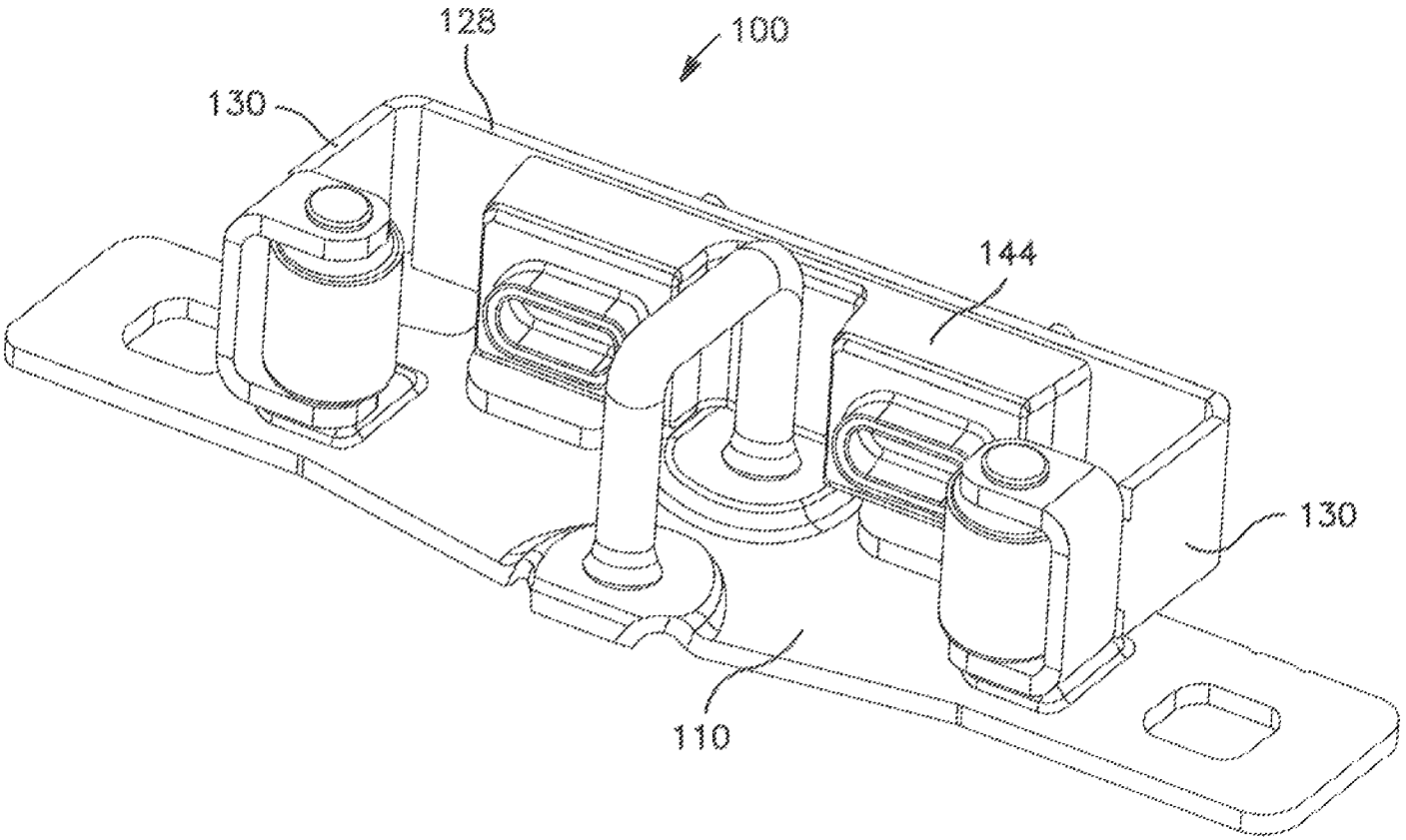
FIG. 7 is still another perspective view thereof.
Figure 8:
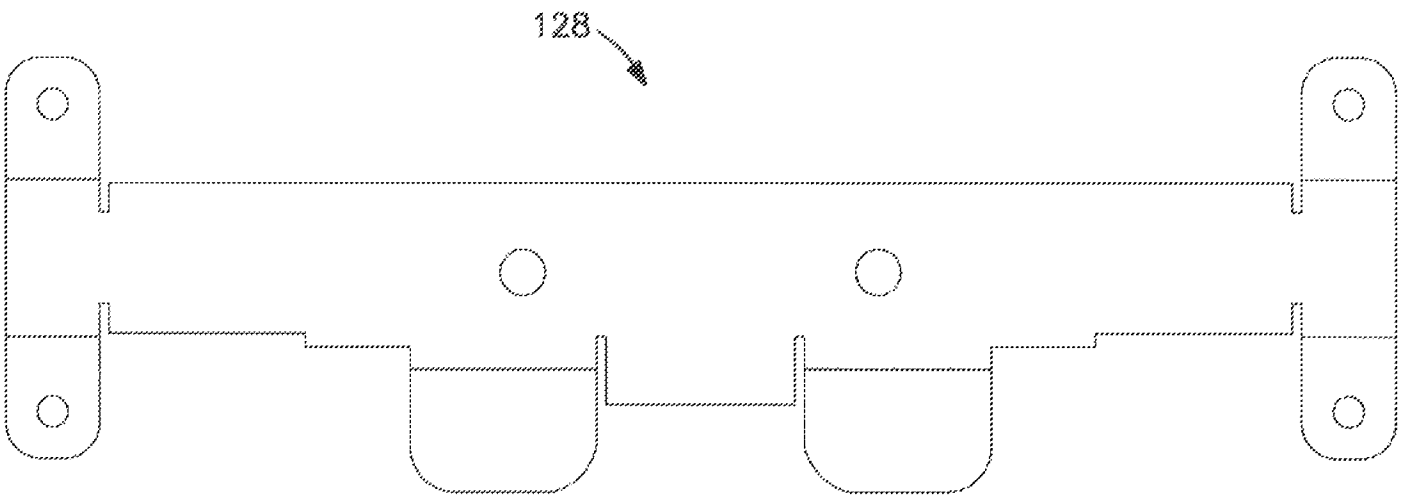
FIG. 8 is a plan view of the striker base, prior to forming.
Figure 9:
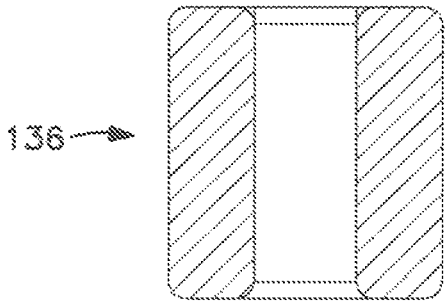
FIG. 9 is a side elevation in section of a roller for the striker assembly.
Figure 11:
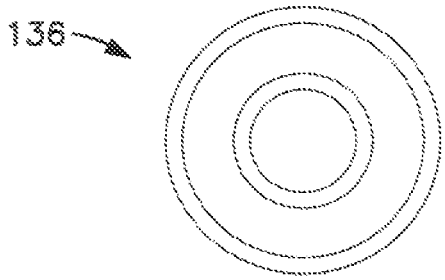
FIG. 11 is a top view thereof.
Figure 10:
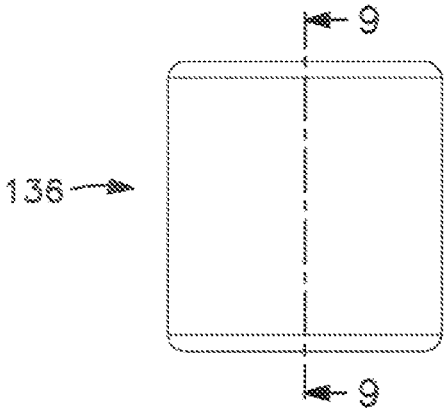
FIG. 10 is a side elevation of the roller of FIG. 9.
Figure 12:
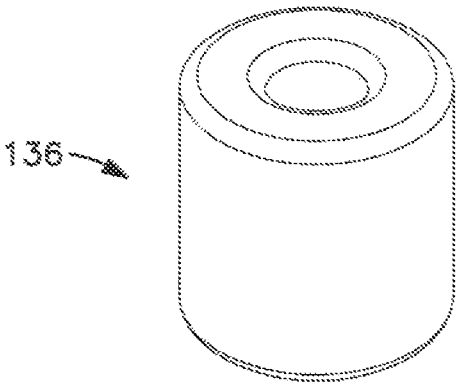
FIG. 12 is a perspective view thereof.
Figure 13:
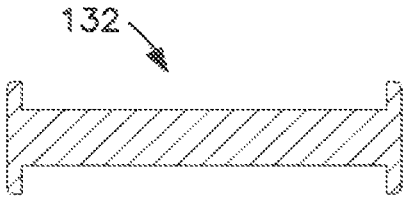
FIG. 13 is a side elevation, in section, of a roller pin for the striker assembly of the present invention.
Figure 14:
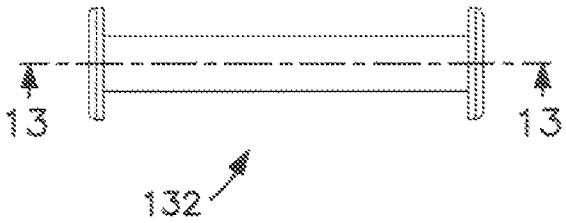
FIG. 14 is a side elevation thereof.
Figure 15:
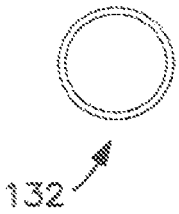
FIG. 15 is an end view thereof.
Figure 16:
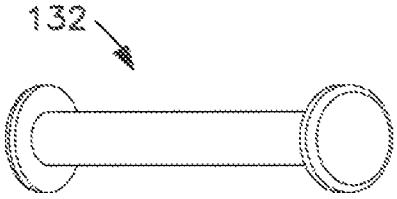
FIG. 16 is a perspective view thereof.
Figure 17:
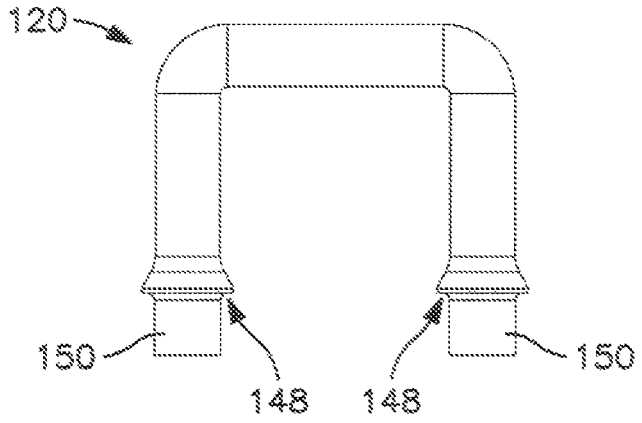
FIG. 17 is a side elevation of the wire form (or striker pin) for the striker assembly according to an embodiment of the invention.
Figure 18:
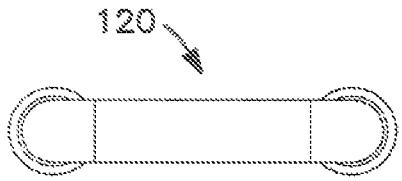
FIG. 18 is a top view thereof.
Figure 19:
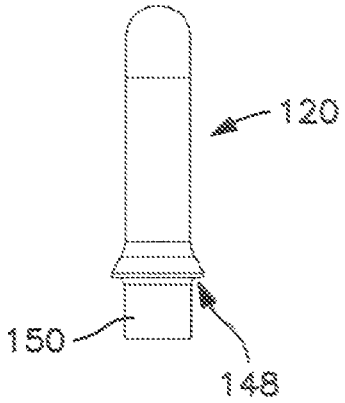
FIG. 19 is an end view thereof.
Figure 20:
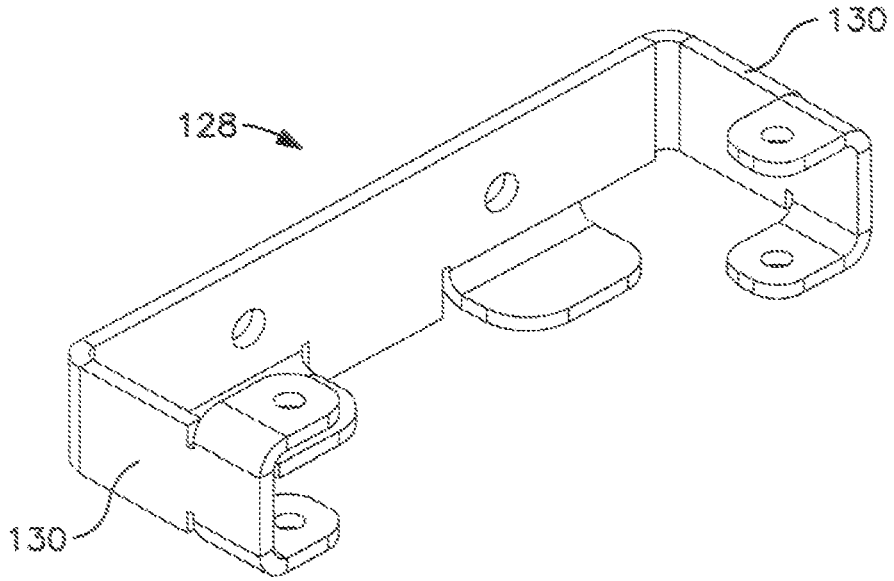
FIG. 20 is a perspective view of the roller support structure for the striker assembly according to an embodiment of the invention.
Figure 21:
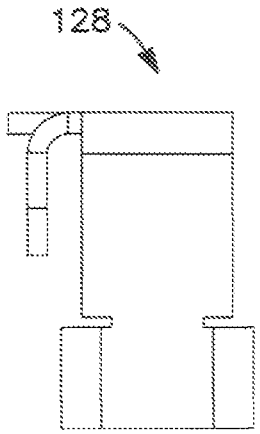
FIG. 21 is an end view thereof.
Figure 22:
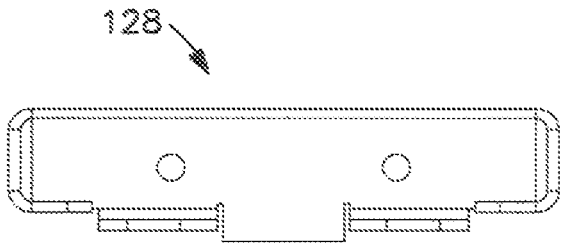
FIG. 22 is a front view thereof.
Figure 23:
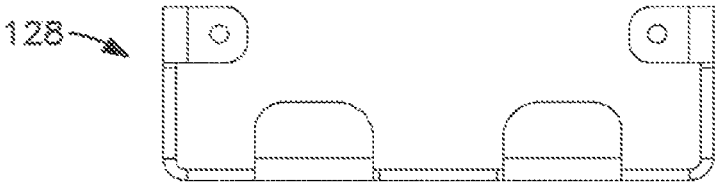
FIG. 23 is a bottom view thereof.
Figure 24:
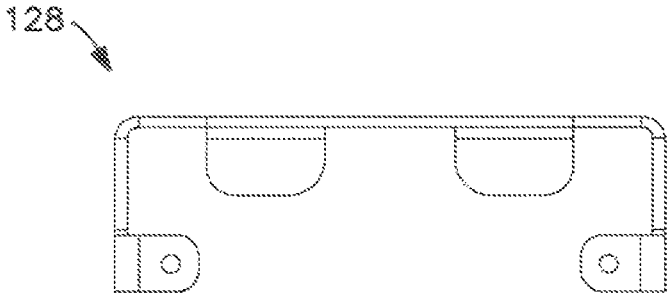
FIG. 24 is a top view thereof.
Figure 25:
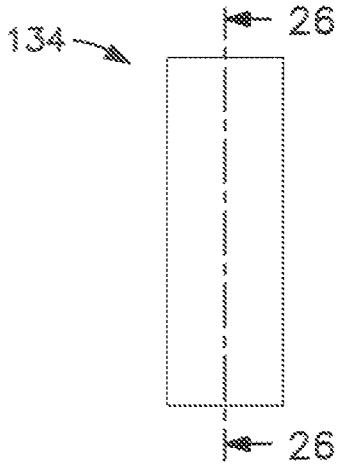
FIG. 25 is a side elevation of a roller sleeve for the striker assembly according to an embodiment of the invention.
Figure 26:
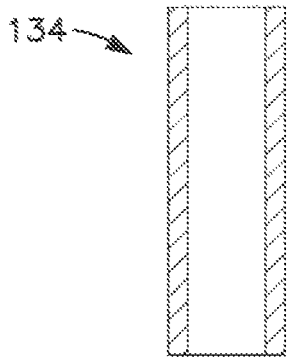
FIG. 26 is a side elevation in section thereof.
Figure 27:
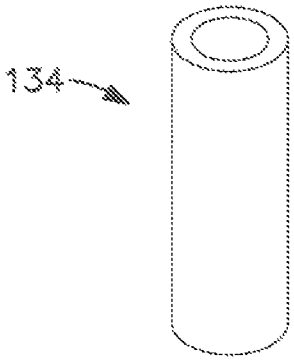
FIG. 27 is a top perspective view thereof.
Figure 28:
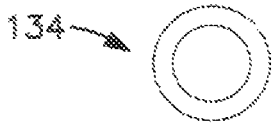
FIG. 28 is an end view thereof.
Figure 29:
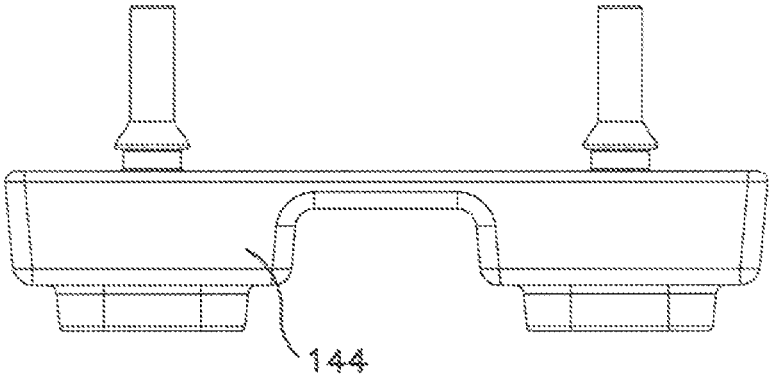
FIG. 29 is a top view of the overtravel bumper for the striker assembly according to an embodiment of the invention.
Figure 30:
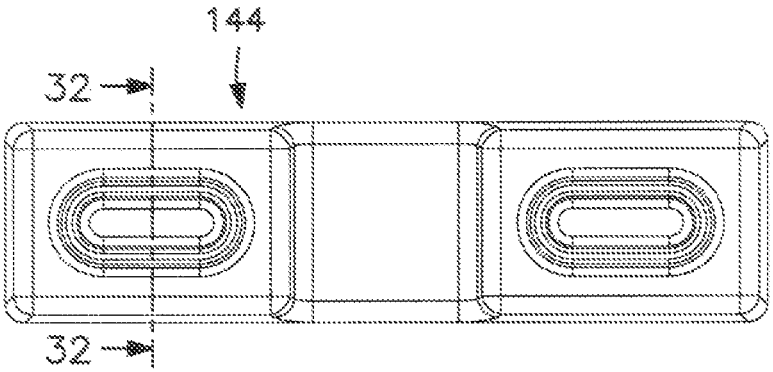
FIG. 30 is a front view thereof.
Figure 31:
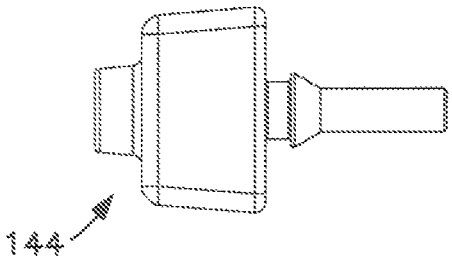
FIG. 31 is an end view thereof.
Figure 32:
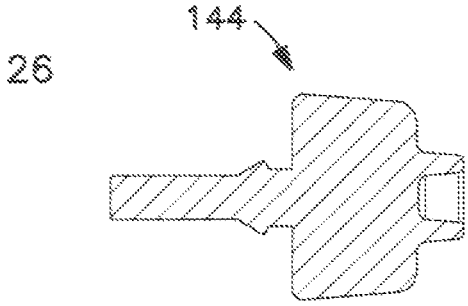
FIG. 32 is a sectional view thereof.
Figure 33:
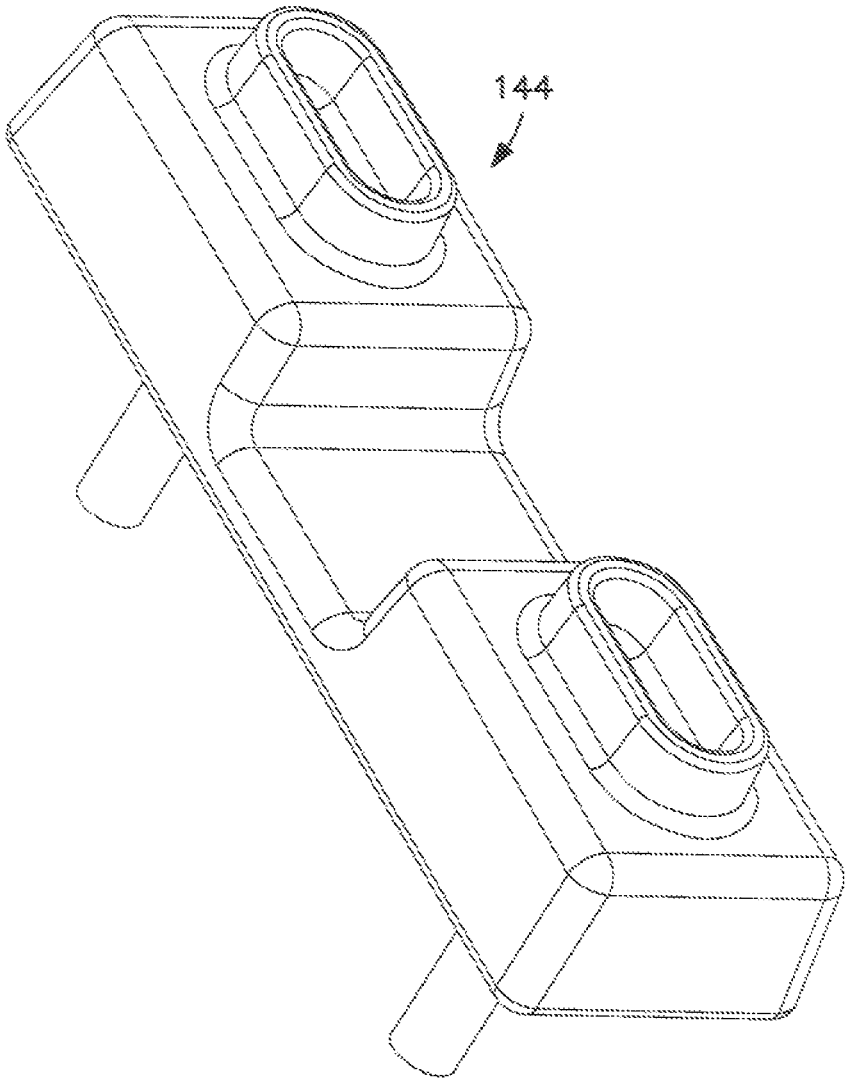
FIG. 33 is a perspective view thereof.

While this invention is susceptible of embodiment in many different forms, there are shown in the drawings and will herein be described in detail, several embodiments with the understanding that the present disclosure should be considered as an exemplification of the principles of the invention and is not intended to limit the invention to the embodiments so illustrated. Further, to the extend that any numerical values or other specifics of materials, etc., are provided herein, they are to be construed as exemplifications of the inventions herein, and the inventions are not to be considered as limited thereby.

Figure 34:
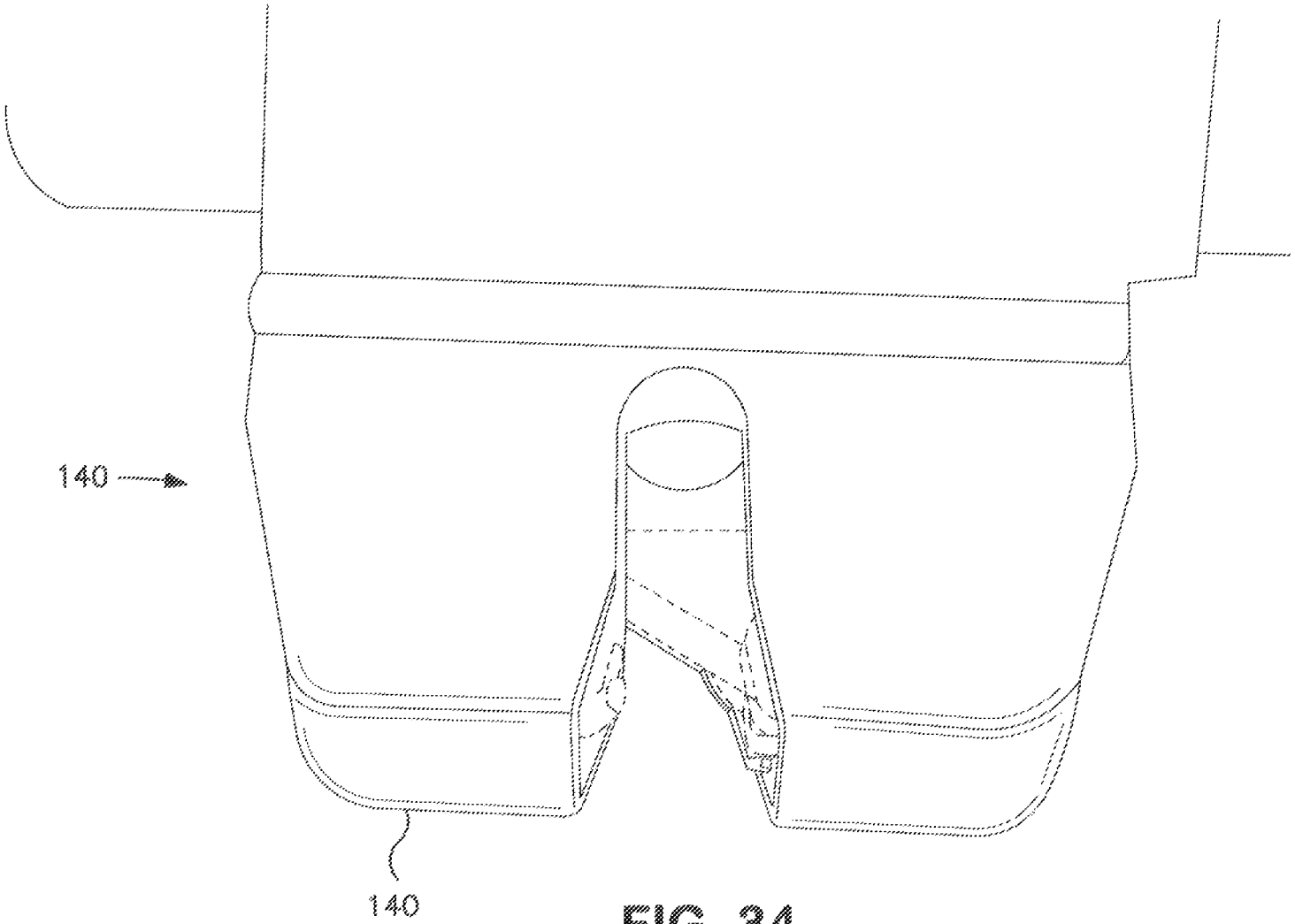
FIG. 34 is a top perspective view of a liftgate latch cover for use with the striker assembly according to an embodiment of the invention.
Figure 35:
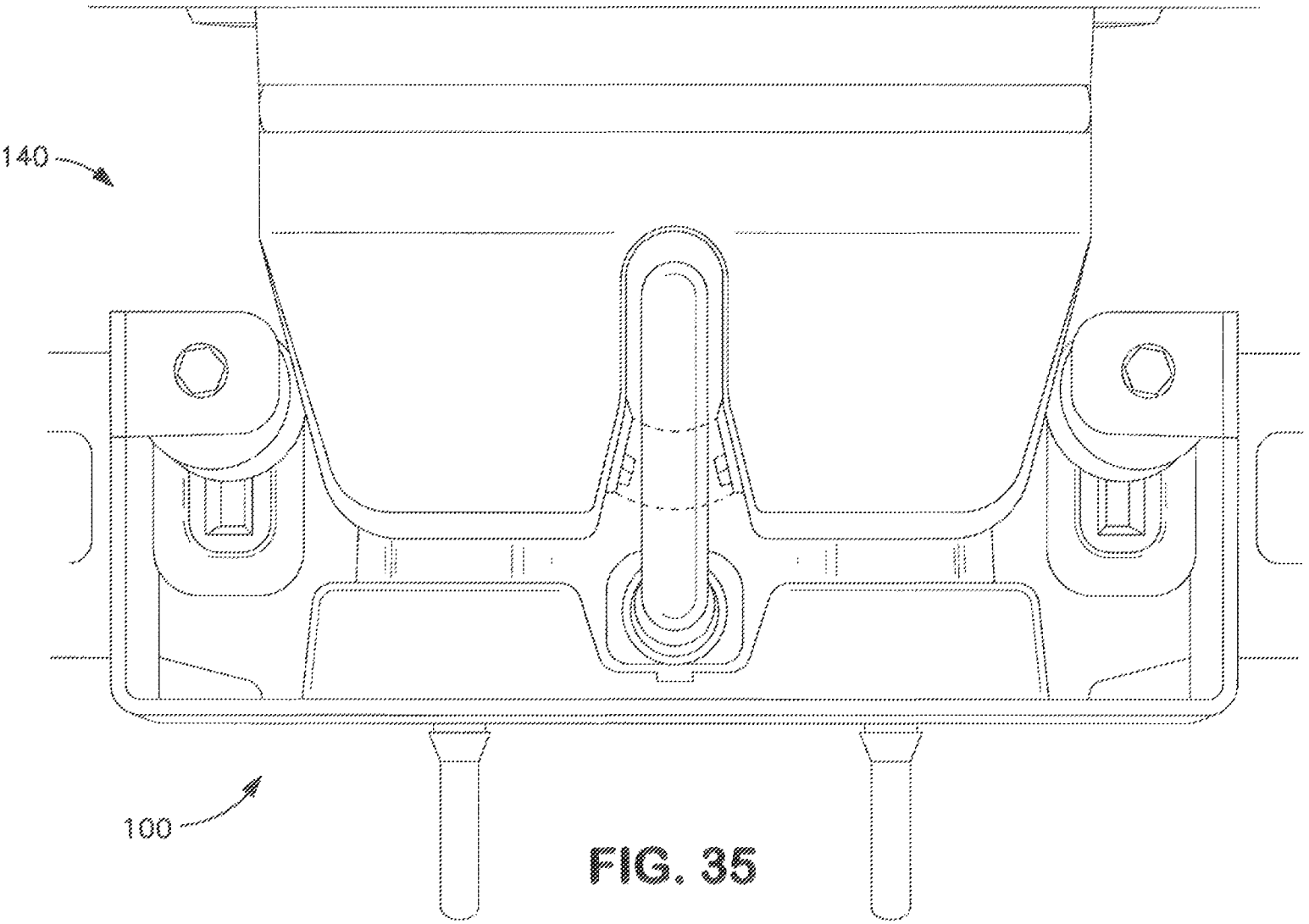
FIG. 35 is a top view of the latch of FIG. 34, shown in engagement with a striker assembly according to an embodiment of the invention.
Figure 36:
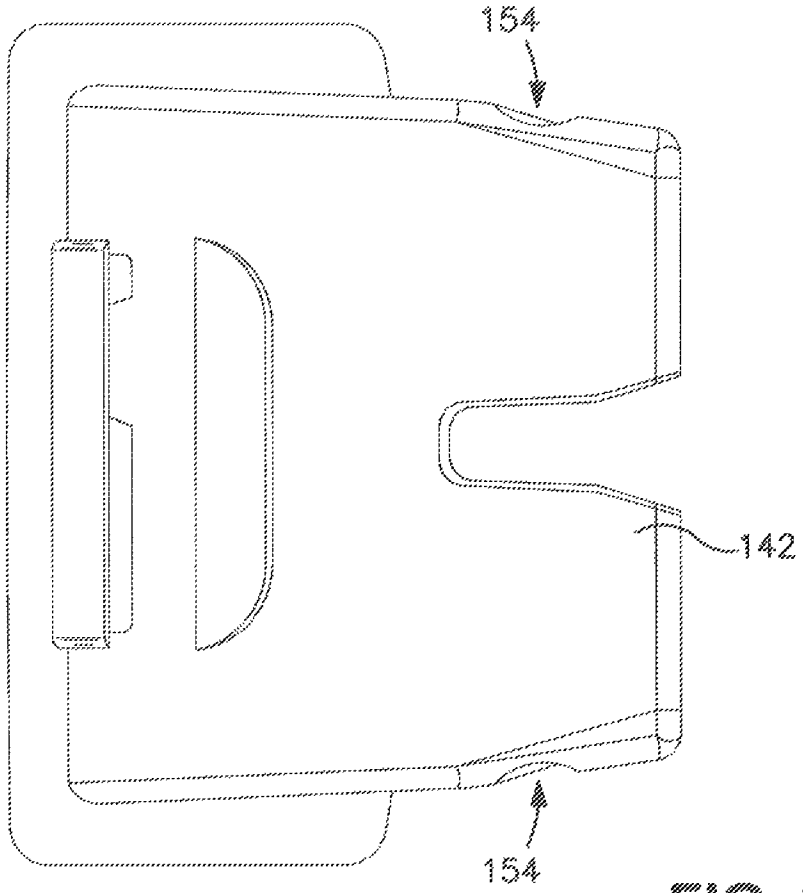
FIG. 36. is a schematic illustration of a latch cover for use with the present invention, showing several alternative configurations.
Figure 37:
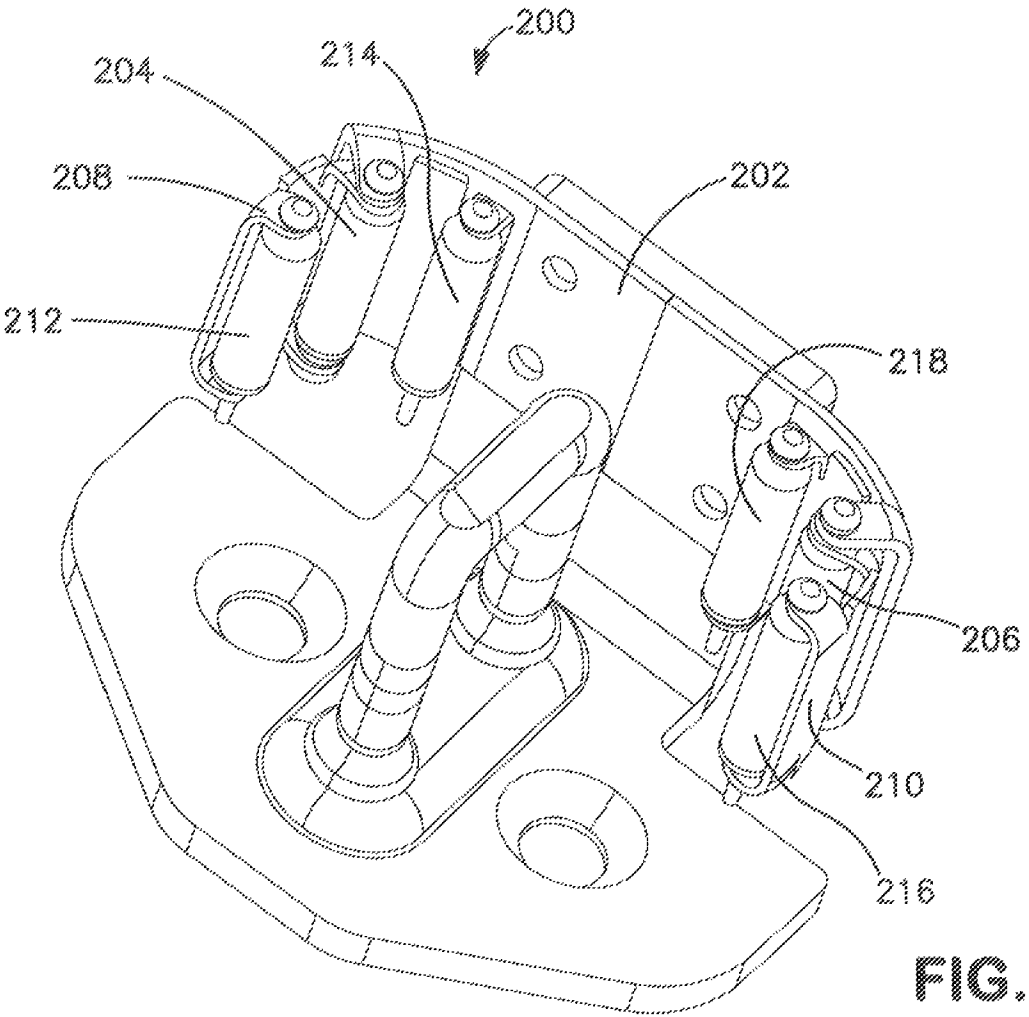
FIG. 37 is a perspective view of a striker configuration according to an alternative embodiment of the invention.
Figure 38:
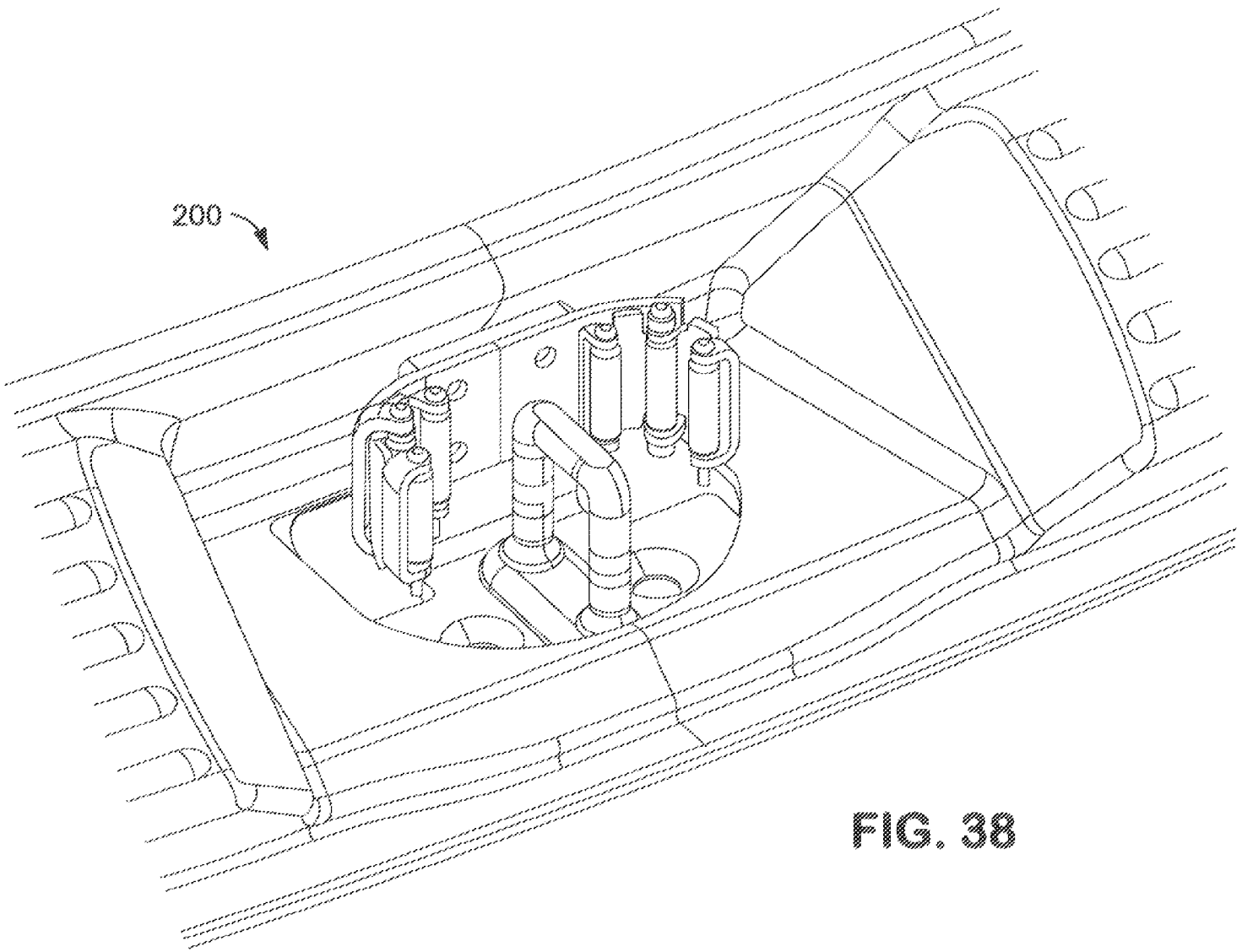
FIG. 38 is a further perspective view thereof.

An embodiment of the vehicle liftgate striker and latch construction of the present invention is shown in FIGS. 1-36. The liftgate striker is intended to reduce door to body vibration and movement. The striker assembly 100 (e.g., FIGS. 1-7) includes base plate 110 and U-shaped wire form 120 as the primary striker features to engage with a latch 140 (FIGS. 34-36) for retention of a vehicle door, hood, deck lid or other closure. It is to be noted that the present invention concerns itself primarily with the interaction between the latch cover 142 and the structures surrounding the striker pin (wire form 120), and not the direct interaction between the latching members and the striker pin (wire form 12) themselves. As such a variety of different latching mechanisms may be employed by one of ordinary skill in the art, without departing from the scope of the present invention. Therefore, the latching mechanism is shown in broken lines in FIGS. 34-35.

The inherent tolerances in a conventional vehicle door/liftgate closure system allow the door to move when closed and the latch is engaged. The internal tolerances of a conventional latch can allow components to move and thus the door which is attached to the latch and or striker is allowed to move and vibrate.

According to the present invention, a tensioned roller assembly provides compression against the latch cover 142 and reduces the free lateral movement of the latch-to-striker interface. The amount of movement is controlled by the amount of tension roller support arms 130 apply to the latch cover 142. The rollers 136 provide minimal friction when engaging with latch 142, because the rollers 136 roll up the sides of the latch cover 142. The over-travel bumper 144 extending transversely across the end of striker frame 128 is provided to limit the amount of movement transverse to the latch 140 whereas the rollers 136 limit the amount of orthogonal or side to side movement. The roller support arms 130 may be a sub-assembly of the overall assembly 100, or a single part formed from the striker base plate 110.

The rollers 136 engage with the latch cover plate 142. The sides of latch cover plate 142 extend at angles, relative to the plane of the wire form 120, to provide modified closing and opening forces. Latch cover 142 may be provided with one or more detents 154 (FIG. 36) located at the full closed (engaged) position to provide an at-rest or neutral area which would require a higher force to move away from and thus provide a limiting action of movement in the transverse direction (the direction of opening and closing of the liftgate). In particular, by coordinating the included angle between the lateral sides of the latch cover 142 with the amount of spring force applied by the roller support arms 130 holding the rollers 136, upon operator release of the latch 140, the roller support arms 130 holding the rollers 136 "squeeze" the latch cover 142, tending to push the latch cover 142 (and hence the liftgate) up and away from the striker assembly 100, thus enabling a lesser strength spring assembly (the springs or torsion arms used to pivotably support the liftgate—not shown) to be used to support for the door.

Striker assembly 100 comprises two resilient spring roller support arms 130 to which the polymer or rubber (or other suitable material) rollers 136 are attached. Striker assembly 100 further includes U-shaped wire-form (striker pin) 120 which engages the latch 140. The elastomer over-travel bumper 144 is provided to protect the latch from damage from excessive door closing forces. In an embodiment of the invention, wire form 120 is formed with preformed faces 148 which engage the front side of the striker base plate 110 (the side that faces the latch). After positioning of the wire-form 120 on base plate 110, the ends 150 of wire-form 120 may be swaged, to create flattened "buttons" to capture base plate 110 between the buttons and the preformed faces. Other modes of attachment, including welding or brazing, may be employed instead of, or in addition to, swaging, without departing from the scope of the invention.

FIGS. 37-40 illustrate a vehicle liftgate striker configuration according to an alternative embodiment of the invention. Striker assembly 200 includes primary roller support spring plate 202, upon which rollers 204 and 206 are pivotably mounted. Secondary roller support spring arms 208, 210, are mounted on the pins which support rollers 204, 206, respectively. Rollers 212, 214 are pivotably mounted on secondary roller support spring arm 208, and rollers 216, 218 are pivotably mounted on secondary roller support spring arm 210. Striker assembly 200 is configured to accommodate known latch housing 220, which is known from the 2010 Ford Flex and 2010 Ford Expedition, among other vehicles, for example. By providing a plurality of rollers on each "side" of the liftgate latch housing, it is believed that a higher static loading will be placed on the liftgate, as compared to prior art liftgate striker assemblies, while at the same time reducing the dynamic loading that is encountered or perceived by a user, while in the process of closing the liftgate. Detents are not provided in the existing vehicle liftgate latch covers just mentioned.

Figure 39:
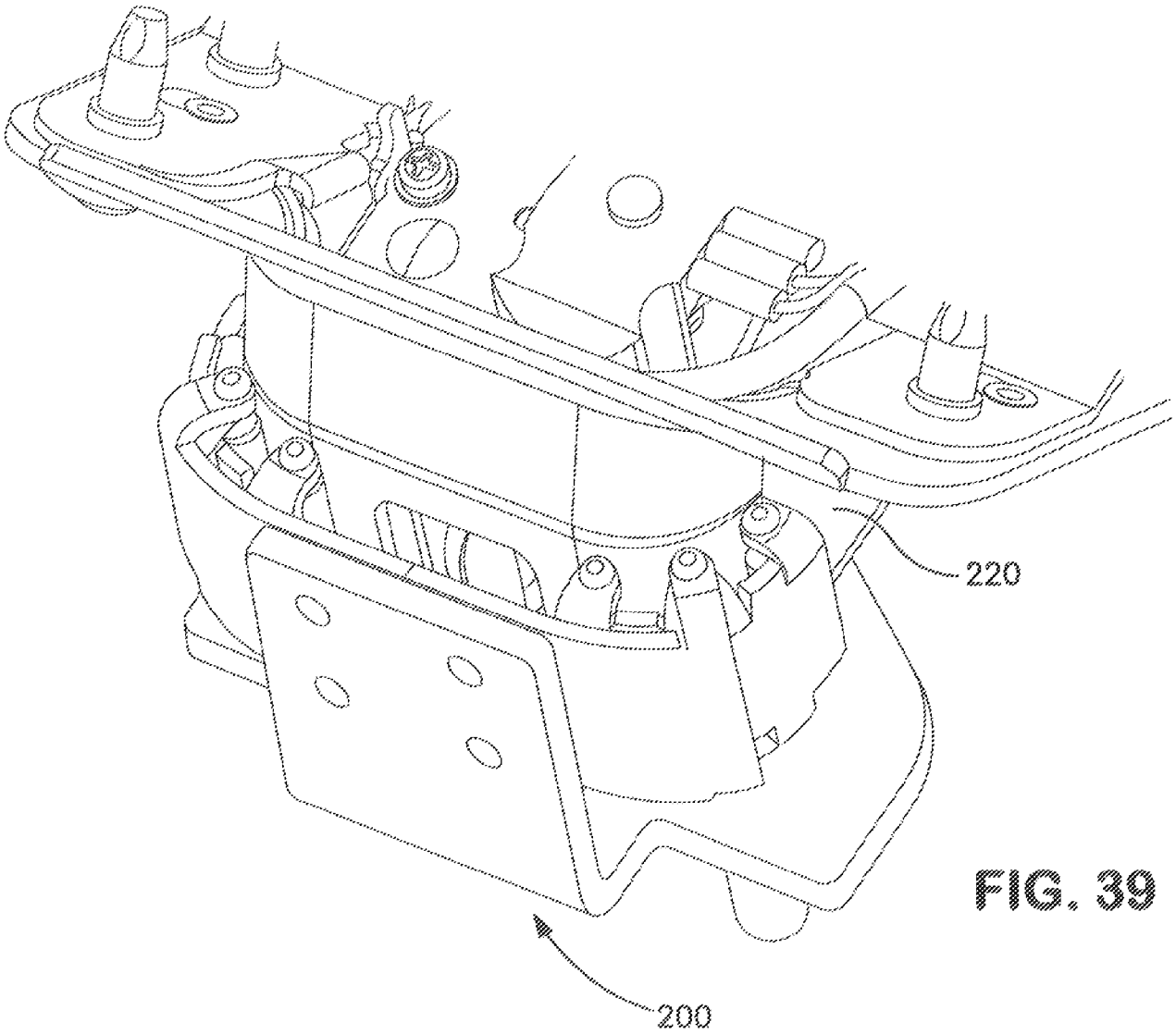
FIG. 39 is a reverse perspective view thereof, showing the interaction between the striker configuration of FIG. 37 and a vehicle liftgate latch.
Figure 40:
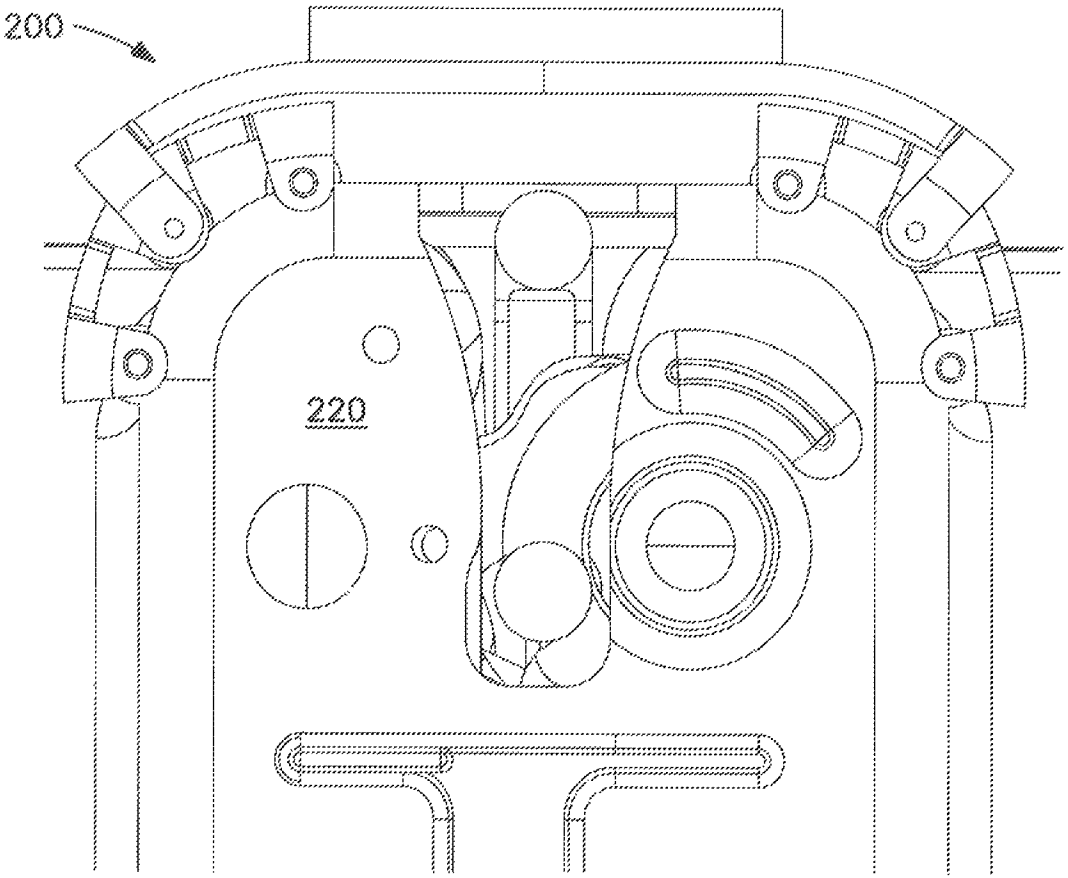
FIG. 40 is a top view of the striker configuration of FIG. 37, in cooperation with a vehicle liftgate latch.

It is further to be understood that while latching structure details may be shown in FIGS. 39 and 40, in association with an alternative embodiment of the invention, it is again the interaction between the striker assembly 200 as a whole, and the latch housing 220, to which the present invention is primarily focused, and not on the particular details of the latch mechanism itself, and other latching mechanisms other than those shown may be used without departing from the scope of the invention.

The foregoing description and drawings merely explain and illustrate the invention, and the invention is not limited thereto, except as those skilled in the art who have the present disclosure before them will be able to make modifications and variations therein without departing from the scope of the invention.

The invention claimed is:

1. A vehicle liftgate striker and latch construction, comprising:

a striker base, operably configured to be mounted to a sill of a vehicle liftgate opening;

a latch, having a latch cover, operably configured to be mounted in a vehicle liftgate, and operably configured to be placed in juxtaposition with the striker base, when the vehicle liftgate is closed;

at least one striker pin, mounted on the striker base, and disposed so as to be engaged by the latch, when the vehicle liftgate is closed;

at least one resilient latch cover reactor assembly, operably disposed on the striker base, for resistively engaging a side surface of the latch cover when the vehicle liftgate is being closed, the at least one resilient latch cover reactor assembly includes at least one support arm operably associated with the striker base, for resilient flexible movement relative thereto; and at least one roller pivotably mounted on the at least one support arm wherein the at least one resilient latch cover reactor assembly is operably configured to push against the latch cover when the vehicle liftgate is closed, and, upon release of the latch, push the vehicle liftgate away from the striker base.

2. The vehicle liftgate striker and latch construction, according to claim 1, further comprising:

at least one bumper disposed on the striker base, for engaging the latch cover, as the latch is being brought into resilient engagement with the at least one striker pin, for preventing over-travel of the latch, relative to the at least one striker pin.

3. The vehicle liftgate striker and latch construction, according to claim 1, wherein the at least one support arm and the at least one roller are configured so that when the vehicle liftgate is closed, and the latch approaches the at least one striker pin, the latch cover contacts the at least one roller, causing the at least one support arm to be flexed, to permit complete juxtapositioning of the latch relative to the striker base, with the at least one roller rolling over a portion of the surface of the latch cover.

4. The vehicle liftgate striker and latch construction according to claim 3, wherein the at least one support arm operably associated with the striker base, for resilient flexible movement relative thereto; and at least one roller pivotably mounted on the at least one support arm further comprise:

one support arm mounted at or proximate one end of the striker base, for resilient flexible movement relative thereto; and one roller pivotably mounted on the one support arm; and another support arm mounted at or proximate an opposite end of the striker base, for resilient flexible movement relative thereto; with another roller pivotably mounted on the another support arm.

5. The vehicle liftgate striker and latch construction according to claim 2, wherein the bumper has a bilaterally symmetrical configuration, with projecting bumper portions disposed to either side of the at least one striker pin.

6. The vehicle liftgate striker and latch construction according to claim 1, wherein side surface of the latch cover is operably disposed so that upon contact with the at least one resilient latch cover reactor assembly during closure of the vehicle liftgate, the side surface exerts force on the at least one resilient latch cover reactor assembly which has a lateral component, tending to push the at least one resilient latch cover reactor assembly sideways, relative to the at least one striker pin.

7. The vehicle liftgate striker and latch construction according to claim 6, wherein the striker base has a longitudinal axis which extends transversely relative to the vehicle in which it is to be mounted, and wherein the side surface of the latch cover is disposed at an oblique angle, relative to the longitudinal axis of the striker base, when the latch is in juxtaposition relative to the striker base.

8. The vehicle liftgate striker and latch construction according to claim 6, further comprising at least one detent disposed in the side surface of the latch cover, which engages the at least one resilient latch cover reactor assembly, for providing resistance against relative movement between the latch and the striker base, when the latch is in juxtaposition to the striker base, when the liftgate is in its closed and locked position.

9. A vehicle liftgate striker and latch construction, comprising:

a striker base, operably configured to be mounted to a sill of a vehicle liftgate opening;

a latch, having a latch cover, operably configured to be mounted in a vehicle liftgate, and operably configured to be placed in juxtaposition with the striker base, when the vehicle liftgate is closed;

at least one striker pin, mounted on the striker base, and disposed so as to be engaged by the latch, when the vehicle liftgate is closed;

at least one resilient latch cover reactor assembly, operably disposed on the striker base, for resistively engaging a side surface of the latch cover when the vehicle liftgate is being closed, the at least one resilient latch cover reactor assembly includes at least one support arm operably associated with the striker base, for resilient flexible movement relative thereto; and at least one roller pivotably mounted on the at least one support arm wherein the at least one resilient latch cover reactor assembly is operably configured to push against the latch cover when the vehicle liftgate is closed, and, upon release of the latch, push the vehicle liftgate away from the striker base;

wherein the at least one resilient latch cover reactor is configured so that when the vehicle liftgate is closed, and the latch approaches the at least one striker pin, the latch cover contacts the at least one roller, causing the at least one support arm to be flexed, to permit complete juxtapositioning of the latch relative to the striker base, with the at least one roller rolling over a portion of the surface of the latch cover.

10. The vehicle liftgate striker and latch construction, according to claim 9, further comprising:

at least one bumper disposed on the striker base, for engaging the latch cover, as the latch is being brought into resilient engagement with the at least one striker pin, for preventing over-travel of the latch, relative to the at least one striker pin.

11. The vehicle liftgate striker and latch construction, according to claim 9, wherein the at least one resilient latch cover reactor assembly comprises:

a primary roller support spring plate attached to the striker base wherein the at least one support arm is attached to the spring plate;

at least one secondary roller support spring arms; and at least one roller pivotably mounted on the at least one secondary roller support spring arm.

12. The vehicle liftgate striker and latch construction according to claim 11, wherein the at least one support arm operably associated with the striker base, for resilient flexible movement relative thereto; and at least one roller pivotably mounted on the at least one support arm further comprise:

one support arm mounted at or proximate one end of the striker base, for resilient flexible movement relative thereto; and one roller pivotably mounted on the one support arm; and another support arm mounted at or proximate an opposite end of the striker base, for resilient flexible movement relative thereto; with another roller pivotably mounted on the another support arm.

13. The vehicle liftgate striker and latch construction according to claim 10, wherein the bumper has a bilaterally symmetrical configuration, with projecting bumper portions disposed to either side of the at least one striker pin.

14. The vehicle liftgate striker and latch construction according to claim 9, wherein side surface of the latch cover is operably disposed so that upon contact with the at least one resilient latch cover reactor assembly during closure of the vehicle liftgate, the side surface exerts force on the at least one resilient latch cover reactor assembly which has a lateral component, tending to push the at least one resilient latch cover reactor assembly sideways, relative to the at least one striker pin.

15. The vehicle liftgate striker and latch construction according to claim 14, wherein the striker base has a longitudinal axis which extends transversely relative to the vehicle in which it is to be mounted, and wherein the side surface of the latch cover is disposed at an oblique angle, relative to the longitudinal axis of the striker base, when the latch is in juxtaposition relative to the striker base.

16. The vehicle liftgate striker and latch construction according to claim 14, further comprising at least one detent disposed in the side surface of the latch cover, which engages the at least one resilient latch cover reactor assembly, for providing resistance against relative movement between the latch and the striker base, when the latch is in juxtaposition to the striker base, when the liftgate is in its closed and locked position.

* * * * *